US008225825B1

(12) United States Patent
Wilhelmi

(10) Patent No.: US 8,225,825 B1
(45) Date of Patent: Jul. 24, 2012

(54) FIRE EXTINGUISHER FILLING AID SYSTEM

(76) Inventor: Jerry L. Wilhelmi, Park City, UT (US)

( * ) Notice: Subject to any disclaimer, the term of this patent is extended or adjusted under 35 U.S.C. 154(b) by 462 days.

(21) Appl. No.: 12/541,228

(22) Filed: Aug. 14, 2009

(51) Int. Cl.
*B65B 1/04* (2006.01)
*A47K 1/08* (2006.01)

(52) U.S. Cl. ..... 141/247; 141/97; 248/312

(58) Field of Classification Search ..... 141/18, 141/97, 98, 247; 248/312
See application file for complete search history.

(56) References Cited

U.S. PATENT DOCUMENTS

| | | | | | |
|---|---|---|---|---|---|
| 1,464,001 | A | * | 8/1923 | Iddings | 169/62 |
| 1,727,213 | A | * | 9/1929 | McMullen | 248/551 |
| 2,017,531 | A | * | 10/1935 | Dodelin | 248/505 |
| 2,499,672 | A | * | 3/1950 | Nurkiewicz | 248/313 |
| 2,521,193 | A | * | 9/1950 | Thompson | 169/11 |
| 2,659,443 | A | * | 11/1953 | Zabriskie | 169/35 |
| 3,565,384 | A | | 2/1971 | Lockwood | |
| 3,942,561 | A | * | 3/1976 | Stoeffler | 141/67 |
| 3,951,185 | A | * | 4/1976 | Bower et al. | 141/1 |
| D245,929 | S | | 9/1977 | Montambo | |
| 4,121,632 | A | * | 10/1978 | Zehr | 141/59 |
| 4,213,592 | A | | 7/1980 | Lingenfelser | |
| 4,303,218 | A | | 12/1981 | Naegeli | |
| 5,210,901 | A | * | 5/1993 | Cooper | 15/302 |
| 5,806,416 | A | * | 9/1998 | Cerniglia et al. | 100/90 |
| 7,287,735 | B2 | | 10/2007 | Heerdt et al. | |
| 2004/0089459 | A1 | | 5/2004 | Folks | |

* cited by examiner

*Primary Examiner* — Timothy L Maust

(57) ABSTRACT

A fire extinguisher filling aid system includes a fire extinguisher and a fill nozzle that is positioned on and fluidly coupled to the fire extinguisher to fill the fire extinguisher. A bottom plate has a top side, a bottom side and a perimeter edge. A bottom end of the extinguisher is positioned on the bottom plate. An upper plate has an upper side, a lower side and a peripheral edge. The peripheral edge has a notch therein. The notch has a width smaller than the fill nozzle and larger than a fill line fluidly coupled to the nozzle to allow the fill line to be positioned within the notch while the upper plate rests upon the fill nozzle. A plurality of tethers is attached to and extends between the upper and bottom plates to retain the fill nozzle on the fire extinguisher.

14 Claims, 3 Drawing Sheets

FIRE EXTINGUISHER FILLING AID SYSTEM

BACKGROUND OF THE DISCLOSURE

Field of the Disclosure

The disclosure relates to fire extinguisher filling aids and more particularly pertains to a new fire extinguisher filling aid for allowing hands free filling of a fire extinguisher.

SUMMARY OF THE DISCLOSURE

An embodiment of the disclosure meets the needs presented above by generally comprising a fire extinguisher and a fill nozzle that is positioned on and fluidly coupled to the fire extinguisher to fill the fire extinguisher. A bottom plate has a top side, a bottom side and a perimeter edge. A bottom end of the extinguisher is positioned on the bottom plate. An upper plate has an upper side, a lower side and a peripheral edge. The peripheral edge has a notch therein. The notch has a width smaller than the fill nozzle and larger than a fill line fluidly coupled to the nozzle to allow the fill line to be positioned within the notch while the upper plate rests upon the fill nozzle. A plurality of tethers is attached to and extends between the upper and bottom plates to retain the fill nozzle on the fire extinguisher.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
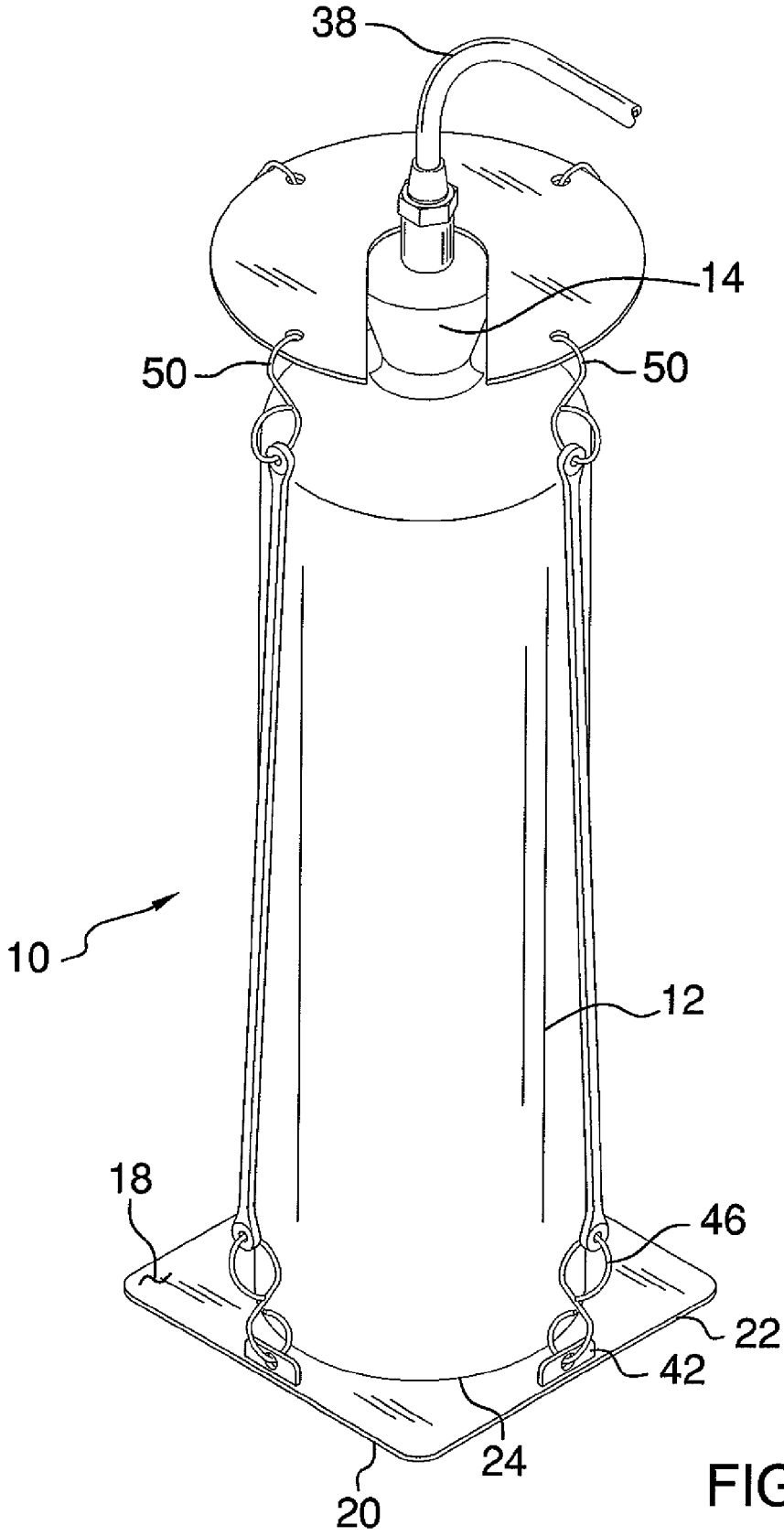
FIG. 1 is an in-use front perspective view of a fire extinguisher filling aid system according to an embodiment of the disclosure.
Figure 2:
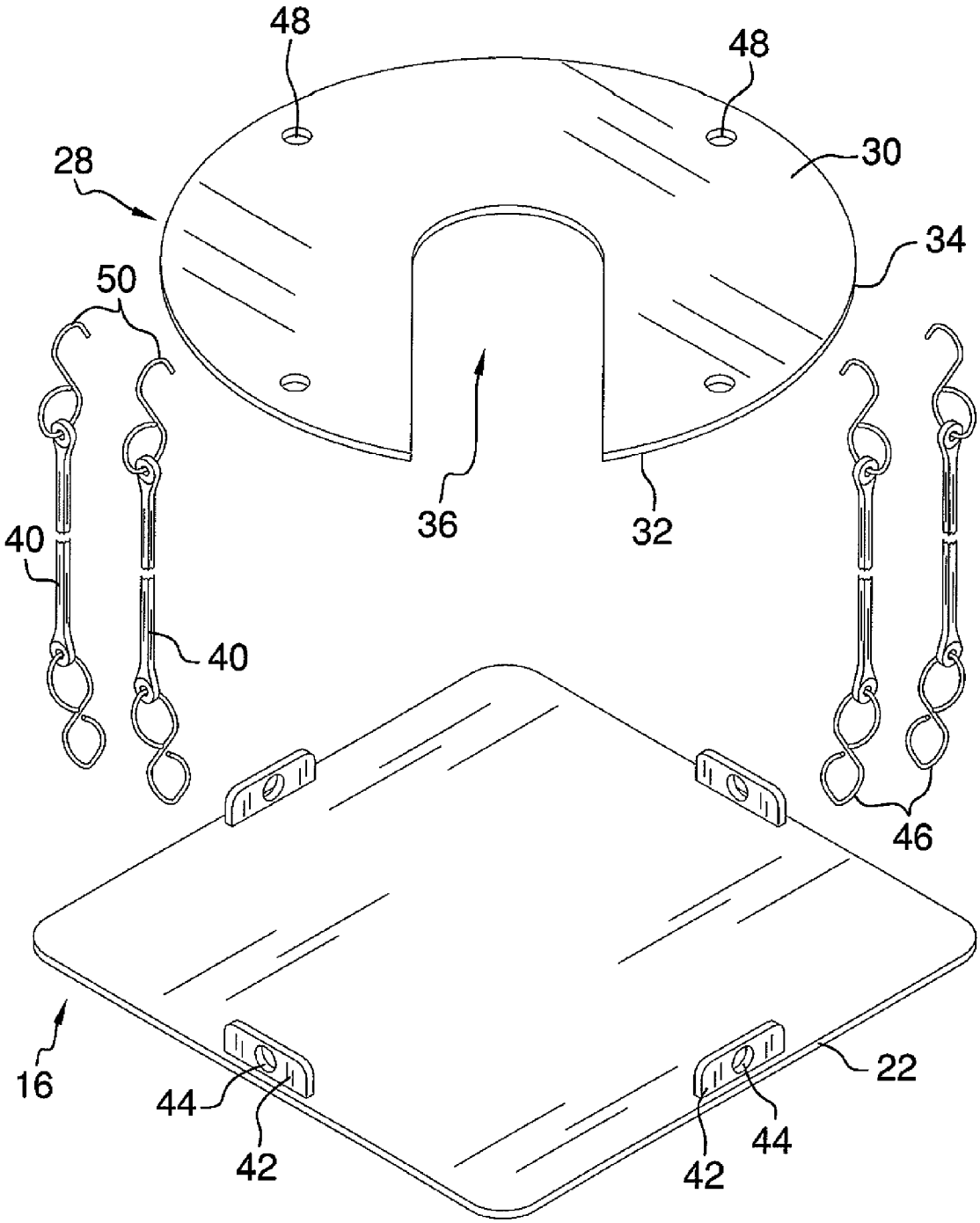
FIG. 2 is a front perspective view of an embodiment of the disclosure.
Figure 3:
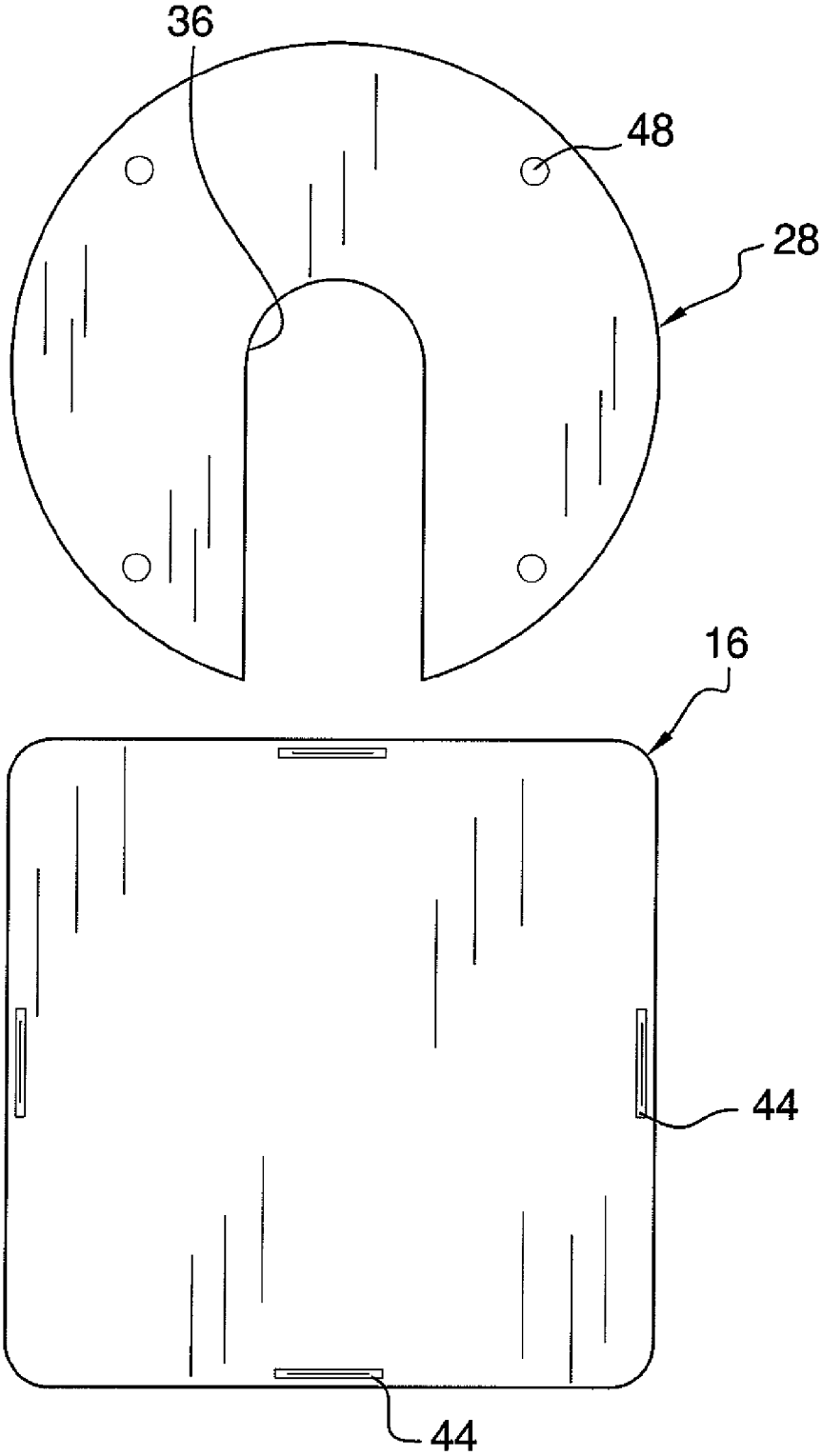
FIG. 3 is a top view of the upper and bottom plates of an embodiment of the disclosure.

With reference now to the drawings, and in particular to FIGS. 1 through 3 thereof, a new fire extinguisher filling aid embodying the principles and concepts of an embodiment of the disclosure and generally designated by the reference numeral 10 will be described.

As best illustrated in FIGS. 1 through 3, the fire extinguisher filling aid system 10 generally comprises a fire extinguisher 12 and a fill nozzle 14 that is positioned on and fluidly coupled to the fire extinguisher 12 to fill the fire extinguisher 12. The fill nozzle 14 is placed on a conventional fire extinguisher 12 after the head of the extinguisher 12 is removed so that the fire extinguisher 12 can be refilled with dry chemical fire retardants.

A bottom plate 16 has a top side 18, a bottom side 20 and a perimeter edge 22. The bottom plate 16 is planar and a bottom end 24 of the extinguisher 12 is positioned on the bottom plate 16. The perimeter edge 22 extends outwardly from the bottom end 24 in all directions. The bottom plate 16 may have a square or rectangular shape as shown in the Figures.

An upper plate 28 has an upper side 30, a lower side 32 and a peripheral edge 34. The peripheral edge 34 has a notch 36 therein and the notch 36 has a width smaller than the fill nozzle 14 and larger than a fill line 38 fluidly coupled to the nozzle 14. This allows the fill line 38 to be positioned within the notch 36 while the upper plate 28 rests upon the fill nozzle 14. The upper plate 28 has a circular shape.

A plurality of tethers 40 is attached to and extends between the upper 28 and bottom 16 plates to retain the fill nozzle 14 on the fire extinguisher 12. This will allow for hands-free filling of the fire extinguisher so that the filling technician can clean the head of the extinguisher 12 while it is being filled. Each of the tethers 40 is comprised of a resiliently stretchable material such as an elastomeric material. The plurality of tethers 40 is generally at least three tethers 40.

The bottom plate 16 includes a plurality of tabs 42 each having an aperture 44 extending therethrough. Each of the tethers 40 has a bottom end comprising a hook 46 that engages one of the tabs 42. The hooks 46 on the bottom ends are preferably closed and therefore alternative couplers may be used. The tabs 42 are positioned adjacent to the perimeter edge 22 and each is spaced equally from adjacent ones of the tabs 42.

The upper plate 28 has a plurality of openings 48 extending therethrough. Each of the tethers 40 has an upper end comprising a hook 50 that engages one of the openings 48. The openings 48 are each positioned adjacent to the peripheral edge 34. The openings 48 are spaced equidistant from the adjacent ones of the openings 48.

In use, the upper plate 28 and the bottom plate 16 are positioned as stated above and as shown in the Figures. The tethers 40 retain the upper plate 28 on top of the fill nozzle 14 so that the technician filling the fire extinguisher 12 need not retain their hand on the fill nozzle 14. While the filling is being performed, the technician will then be free to attend to other duties such as cleaning the head for the fire extinguisher 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A filling aid system including:

a fire extinguisher and a fill nozzle being positioned on and fluidly coupled to said fire extinguisher to fill said fire extinguisher;

a bottom plate having a top side, a bottom side and a perimeter edge, a bottom end of said extinguisher being positioned on said bottom plate;

an upper plate having an upper side, a lower side and a peripheral edge, said peripheral edge having a notch therein, said notch having a width smaller than said fill nozzle and larger than a fill line fluidly coupled to said nozzle to allow said fill line to be positioned within said notch while said upper plate rests upon said fill nozzle; and a plurality of tethers being attached to and extending between said upper and bottom plates to retain said fill nozzle on said fire extinguisher, said upper plate having a plurality of openings extending therethrough, each of said tethers having an upper end comprising a hook engaging one of said openings.

2. The system according to claim 1, wherein said perimeter edge of said bottom plate extends outwardly from said bottom end in all directions.

3. The system according to claim 1, wherein said upper plate has a circular shape.

4. The system according to claim 1, wherein each of said tethers is comprised of a resiliently stretchable material.

5. The system according to claim 1, wherein said bottom plate includes a plurality of tabs each having an aperture extending therethrough, each of said tethers having a bottom end comprising a hook engaging one of said tabs.

6. The system according to claim 5, wherein said tabs are each positioned adjacent to said perimeter edge.

7. The system according to claim 5, wherein each of said tabs is spaced equally from adjacent ones of said tabs.

8. The system according to claim 1, wherein said openings each are positioned adjacent to said peripheral edge.

9. The system according to claim 1, wherein each of said openings is spaced equidistant from said adjacent ones of said openings.

10. A filling aid apparatus for a fire extinguisher to retain a fill nozzle on the fire extinguisher, said apparatus including:

a bottom plate having a top side, a bottom side and a perimeter edge, a bottom end of said extinguisher being positionable on said bottom plate;

an upper plate having an upper side, a lower side and a peripheral edge, said peripheral edge having a notch therein, said notch having a width smaller than said fill nozzle and larger than a fill line fluidly coupled to said nozzle to allow said fill line to be positionable within said notch while said upper plate is positionable upon said fill nozzle; and a plurality of tethers being attached to and extending between said upper and bottom plates to retain said fill nozzle on said fire extinguisher;

wherein said perimeter edge of bottom plate extends outwardly from said bottom end in all directions;

wherein each of said tethers is comprised of a resiliently stretchable material;

wherein said bottom plate includes a plurality of tabs each having an aperture extending therethrough, each of said tethers having a bottom end comprising a hook engaging one of said tabs;

wherein said upper plate has a plurality of openings extending therethrough, each of said tethers having an upper end comprising a hook engaging one of said openings.

11. The system according to claim 10, wherein said upper plate has a circular shape.

12. The system according to claim 10, wherein said tabs are each positioned adjacent to said perimeter edge, each of said tabs being spaced equally from adjacent ones of said tabs.

13. The system according to claim 10, wherein said openings each are positioned adjacent to said peripheral edge, each of said openings being spaced equidistant from said adjacent ones of said openings.

14. A filling aid system including:

a fire extinguisher and a fill nozzle being positioned on and fluidly coupled to said fire extinguisher to fill said fire extinguisher;

a bottom plate having a top side, a bottom side and a perimeter edge, a bottom end of said extinguisher being positioned on said bottom plate, said perimeter edge of said bottom plate extending outwardly from said bottom end in all directions;

an upper plate having an upper side, a lower side and a peripheral edge, said peripheral edge having a notch therein, said notch having a width smaller than said fill nozzle and larger than a fill line fluidly coupled to said nozzle to allow said fill line to be positioned within said notch while said upper plate rests upon said fill nozzle, said upper plate having a circular shape;

a plurality of tethers being attached to and extending between said upper and bottom plates to retain said fill nozzle on said fire extinguisher, each of said tethers being comprised of a resiliently stretchable material;

said bottom plate including a plurality of tabs each having an aperture extending therethrough, each of said tethers having a bottom end comprising a hook engaging one of said tabs, said tabs being positioned adjacent to said perimeter edge, said tabs being spaced equally from adjacent ones of said tabs; and said upper plate having a plurality of openings extending therethrough, each of said tethers having an upper end comprising a hook engaging one of said openings, said openings each being positioned adjacent to said peripheral edge, said openings being spaced equidistant from said adjacent ones of said openings.

* * * * *